US007573362B2

(12) United States Patent
Thiel et al.

(10) Patent No.: US 7,573,362 B2
(45) Date of Patent: Aug. 11, 2009

(54) HIGH CURRENT, MULTIPLE AIR GAP, CONDUCTION COOLED, STACKED LAMINATION INDUCTOR

(75) Inventors: Clifford G. Thiel, Stillman Valley, IL (US); Darin Driessen, Rockford, IL (US); Debabrata Pal, Hoffman Estates, IL (US); Frank Feng, Loves Park, IL (US)

(73) Assignee: Hamilton Sunstrand Corporation, Rockford, IL (US)

( * ) Notice: Subject to any disclaimer, the term of this patent is extended or adjusted under 35 U.S.C. 154(b) by 332 days.

(21) Appl. No.: 11/247,575

(22) Filed: Oct. 11, 2005

(65) Prior Publication Data

US 2007/0080769 A1 Apr. 12, 2007

(51) Int. Cl.
*H01F 17/06* (2006.01)

(52) U.S. Cl. ..... 336/178

(58) Field of Classification Search ..... 336/65, 336/178, 206, 234, 55–62, 180–186, 198
See application file for complete search history.

(56) References Cited

U.S. PATENT DOCUMENTS 4,603,314 A * 7/1986 Fukunaga et al. ..... 336/65
6,771,157 B2 * 8/2004 Nishikawa et al. ..... 336/178
7,342,475 B2 * 3/2008 Weger ..... 336/200

* cited by examiner

*Primary Examiner*—Tuyen Nguyen
(74) *Attorney, Agent, or Firm*—Carlson, Gasley & Olds PC

(57) ABSTRACT

A power inductor assembly includes and multiple coil sections disposed upon a mounting frame. Multiple winding sections each encircle one of the multiple core sections and a portion of the mounting frame. Air gap spacers separate adjacent core sections. The arrangement facilitates removal of thermal energy from the magnetic core. Lamination build direction normal to inductor mounting surface minimizes eddy current losses.

19 Claims, 4 Drawing Sheets

HIGH CURRENT, MULTIPLE AIR GAP, CONDUCTION COOLED, STACKED LAMINATION INDUCTOR

BACKGROUND OF THE INVENTION

The present invention relates generally to an inductor and, more particularly, to an inductor with multiple air gaps for thermal management.

High power motor controllers typically require inductors exhibiting stable inductance at both high magnitude currents and at frequencies ranging from DC to tens of kilohertz. Parameters for one such inductor, typical of aerospace applications, operates at: 35 μH rated for 260 A at 1,400 Hz continuous. An inductor designed to these parameters should retain 90% inductance at DC currents up to 880 amps. These inductors, specifically power quality filter inductors, should be lightweight and be configured for conduction cooling. Use in aerospace applications heightens the need for lightweight inductors.

Many conventional inductor permutations attempt to meet desired performance parameters yet minimize inductor weight. One such inductor is a gapped tape-wound cut core inductor. This type of inductor contains a magnetic core and typically exhibits high losses around the air gaps due to magnetic core eddy currents which are caused by flex fringing near the air gaps in the magnetic core. As a result, the heat generated by the inductor may most noticeably increase in the areas adjacent the air gaps. In addition, high temperatures may be realized in inductor portions proximate the air gaps. Air gaps in the magnetic path create a high reluctance path, avoiding saturation of the magnetic field at lower frequencies.

Powder magnetic core materials have been used in an attempt to reduce the high temperatures. The powder core materials inherently contain distributed air gaps, which minimize flux fringing and eddy current losses. However, as the DC magnetizing force of the inductor increases, the effective permeability of the powder core drops significantly which thereby limits the effectiveness of the powder magnetic core material to reduce inductor temperatures, especially in inductors producing high magnetizing forces.

Reducing the number of coil turns increases the current with which the permeability of the powder core drop becomes unacceptable. However, to maintain the desired inductance, the cross-sectional area of the powder core must increase substantially in response to a decrease in the number of coil turns, such that the overall weight of the inductor increases, with disadvantageous results for aerospace applications.

Other attempts to minimize the high temperatures generated by the inductors include eliminating entirely the ferromagnetic core. This approach results in an air core inductor with no air gaps or gap losses but requires a significant number of turns and relatively large diameter inductors coils to generate sufficient inductance. Eliminating the ferromagnetic core also induces high magnetic fields outside of the area enclosed by the coil windings, which may heat metal surfaces near the inductor and may interfere with the fields of other inductors in the area. Thus, the elimination of the ferromagnetic core results in a relatively large mounting footprint and stray magnetic fields, which may have disadvantageous results in aerospace applications.

Accordingly, it is desirable to provide an inductor for aerospace applications that minimizes eddy current losses and effectively facilitates inductor heat conduction.

SUMMARY OF THE INVENTION

A cut core inductor assembly having a magnetic core disposed in a winding. An electric current travels through the inductor assembly generating a magnetic field and thermal energy.

The magnetic core includes magnetic core sections on a mounting frame. The winding includes winding sections each encircling one of the magnetic core sections and the mounting frame. Multiple air gap spacers separate adjacent magnetic core sections of the magnetic core. Thermal energy removed from the magnetic core is communicated to the mounting frame.

The magnetic core section includes substantially rectangular profiled magnetic laminations arranged in a stack upon a planar mounting surface of the mounting frame. The stack of magnetic laminations extends from the mounting frame and perpendicular to the planar mounting surface. Upturned flanges on the mounting frame partially secure the magnetic laminations.

The present invention therefore provides a power inductor assembly which efficiently conducts heat from the magnetic core while minimizing eddy current losses and maintaining a desired inductance level.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
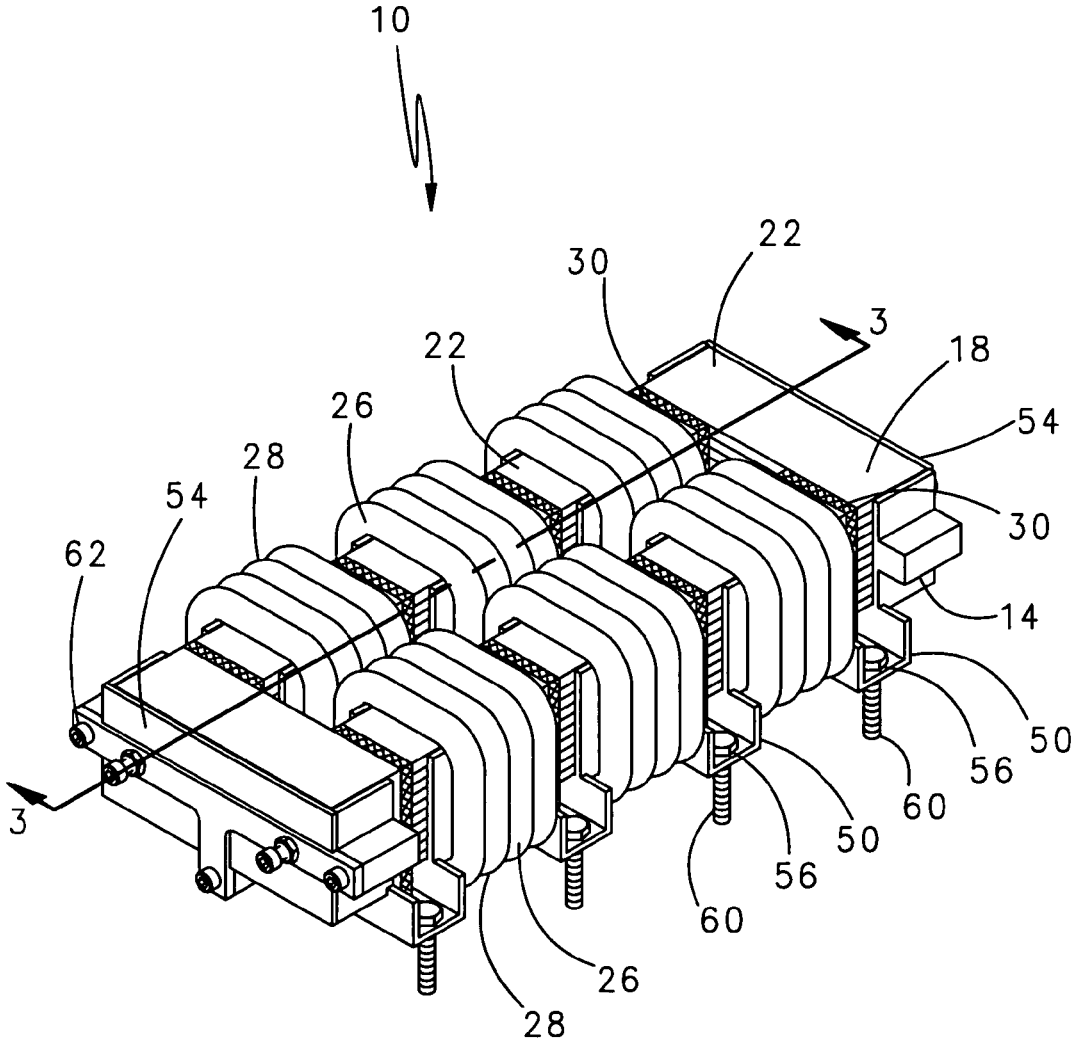
FIG. 1 is an isometric view of the preferred embodiment of the present invention.

FIG. 1 illustrates an isometric view of a typical cut core inductor assembly 10 having a magnetic core 18 disposed in a winding 26. The magnetic core 18 includes a multitude of magnetic core sections 22 arranged on a mounting frame 14. The winding 26 includes a multitude of winding sections 28 each encircling a portion of one of the magnetic core sections 22 and a portion of the mounting frame 14. Multiple air gap spacers 30 separate adjacent magnetic core sections 22 of the magnetic core 18. An electric current travels through the inductor assembly 10 generating a magnetic field and thermal energy.

The inductor assembly 10 may include magnetic core sections 22 of varying sizes. For example, the inductor assembly 10 may include larger magnetic core sections 22 near the ends of the inductor assembly 10. It should be understood that although a rectangular inductor assembly 10 is described, various other geometries or arrangements of magnetic core sections 22 are included within the scope of this invention, including, toroidal or polygonal geometries.

Figure 2:
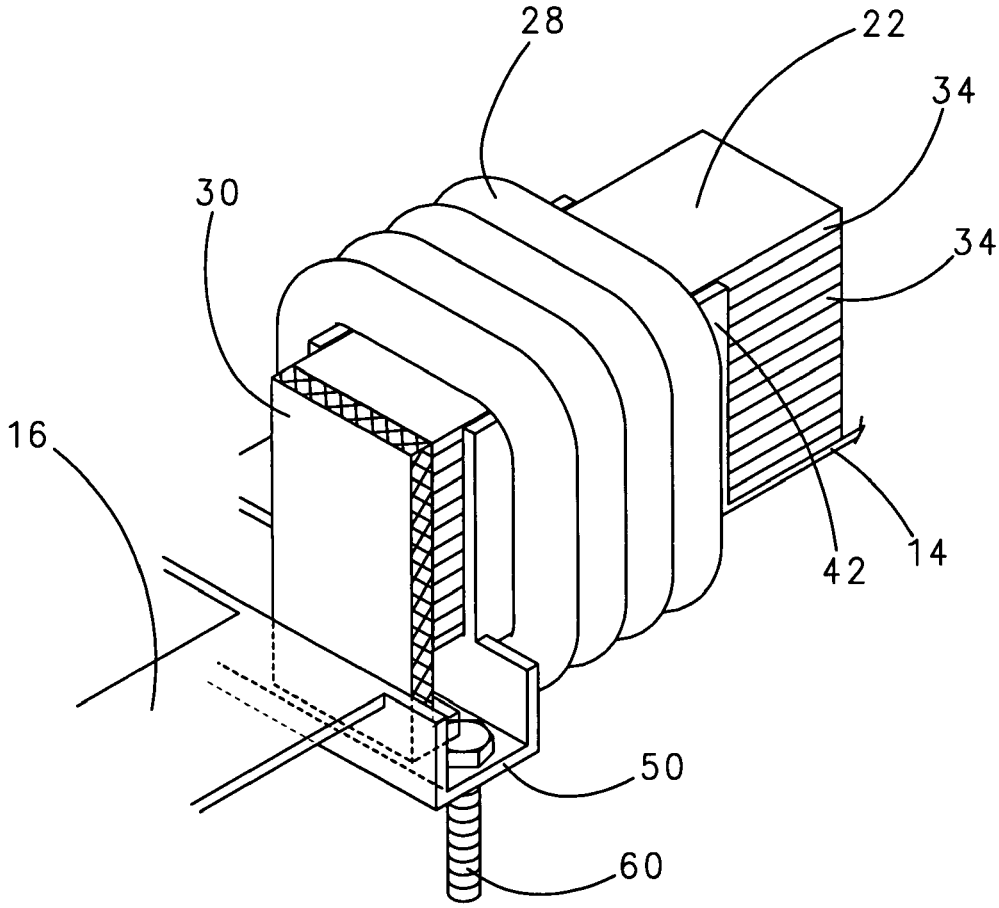
FIG. 2 is an expanded view of the magnetic core section secured in a portion of the mounting frame.

Referring to FIG. 2, magnetic core section 22 includes a multitude of substantially rectangular profiled magnetic laminations 34 arranged in a stack upon a planar mounting surface 16 defined by the mounting frame 14. The stack of magnetic laminations 34 extends from the mounting frame 14 and perpendicular to the planar mounting surface 16. Arranging the magnetic laminations 34 in this way creates a coplanar path for the magnetic field traveling through the magnetic core section 22. The horizontal stack of magnetic laminations 34 results in lower induction heating losses than other arrangements of magnetic laminations 34, e.g., vertical arrangements. Upturned flanges 42 on the mounting frame 14 partially secure the magnetic laminations 34 upon the planer mounting surface 16.

The winding section 28 surrounds a segment of the magnetic core section 22 and a portion of the mounting frame 14, further securing the magnetic laminations 34 upon the planer mounting surface 16 of the mounting frame 14. The winding section 28 contacts both the mounting frame 14 and a portion of the magnetic core section 22 to facilitate thermal energy transfer to the mounting frame 14. The coil windings 26 are typically copper or other highly conductive material. In addition, the coil windings 26 and the magnetic core sections 22 may include a thermally conductive encapsulating material for reducing thermal impedance. The coil winding 26 arrangements and the encapsulating material result in reduced operating temperatures of the inductor assembly 10.

The air gap spacer 30 is disposed between adjacent magnetic core sections 22. The winding section 28 encircles the magnetic core section 22 but need not encircle the air gap spacer 30. Segregating the air gap spacer 30 in this manner optimizes the air gaps in the inductor assembly 10. In addition, flux fringe induced eddy current losses typically peak in the central portion of the magnetic core section 22 and at the perimeter of the magnetic core section 22 which may create a build-up of thermal energy in those portions of the magnetic core section 22. The position of the air gap spacer 30 facilitates removal of thermal energy from the perimeter of the magnetic core section 22 while the position of the winding section 28 facilitates removal of thermal energy from the central portion of the magnetic core section 22.

The air gap spacer 30 extends past the stacks of magnetic laminations 34 to contact a mounting foot 50 of the mounting frame 14. The mounting foot 50 provides an attachment surface to secure the inductor assembly 10 to a desired location. Thermal energy is thereby readily transferred from the magnetic core 18 to the mounting frame 14. Preferably, the air gap spacer 30 is made of a material having a high thermal conductivity and high electrical resistivity, such as aluminum nitride.

As the inductor assembly 10 utilizes multiple air gap spacers 30, the eddy current effect is dispersed around the magnetic core 18 such that losses in inductance due to eddy currents in the magnetic core 18 are reduced. The air gap spacer 30 creates a high reluctance path in the magnetic core 18, avoiding saturation at low frequencies. The multiple air gap spacers 30 provide multiple paths for thermal energy from the magnetic core 18, facilitating rapid conduction of thermal energy from the magnetic core 18. It should be understood that an increase in the number of air gap spacers 30 or the thickness of the existing air gap spacer 30 will modify the inductance of the inductor assembly 10.

Figure 3:
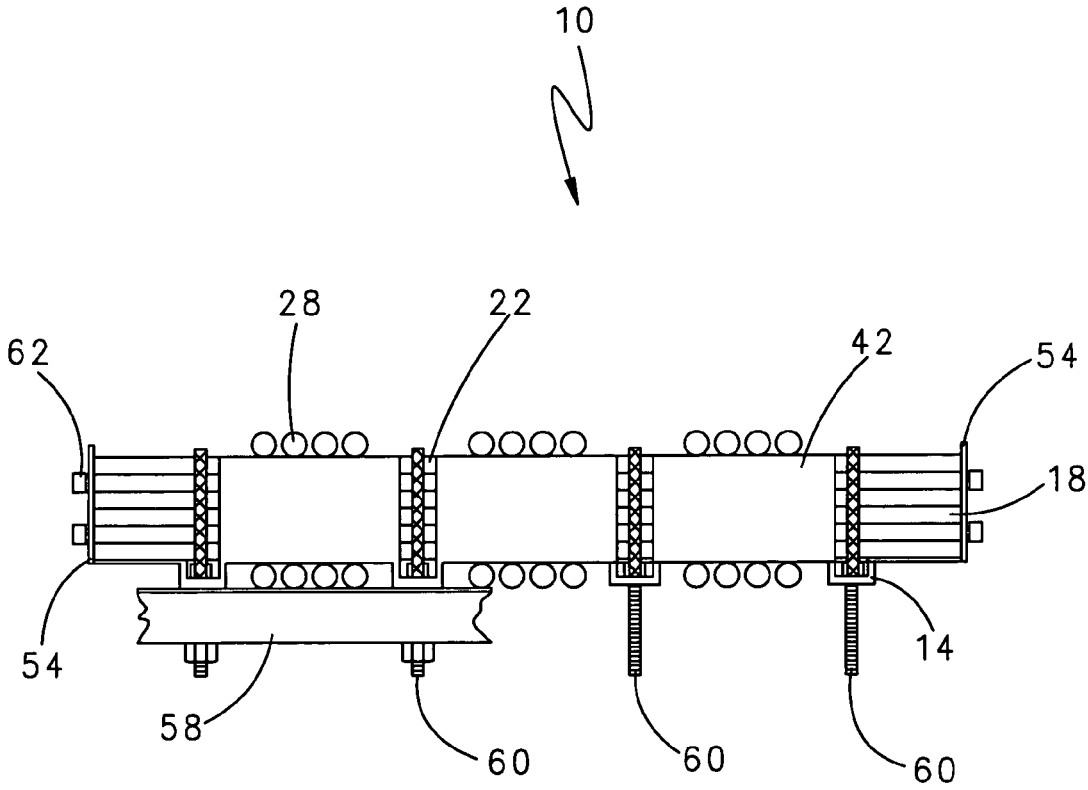
FIG. 3 is a cross-sectional view taken thorough line 3-3 of FIG. 1.

Referring to FIG. 3, thermal energy removed from the magnetic core section 22 is communicated to the mounting frame 14 whereupon the heat sink plate 58 removes thermal energy from the mounting frame 14. Threaded fasteners 60, such as bolts, extend from the mounting frame 14 through access holes 56 in the heat sink plate 58 to secure the heat sink plate 58 to the mounting frame 14. Similar threaded fasteners 60, extend through mounting foot 50 to secure the mounting frame 14 to a surface upon which the inductor assembly 10 is mounted.

Threaded tie-rods 62, or other such fasteners, extend through endplates 54 on opposing sides of the inductor assembly 10. Tightening the threaded tie-rods 62 draws the end plates 54 together securing the stacks of the magnetic laminations 34 and the air gap spacers 30 between them. The threaded tie-rods 62 and the end plates 54 effectively clamp multiple air gap spacers 30 between multiple magnetic core sections 22.

Figure 4:
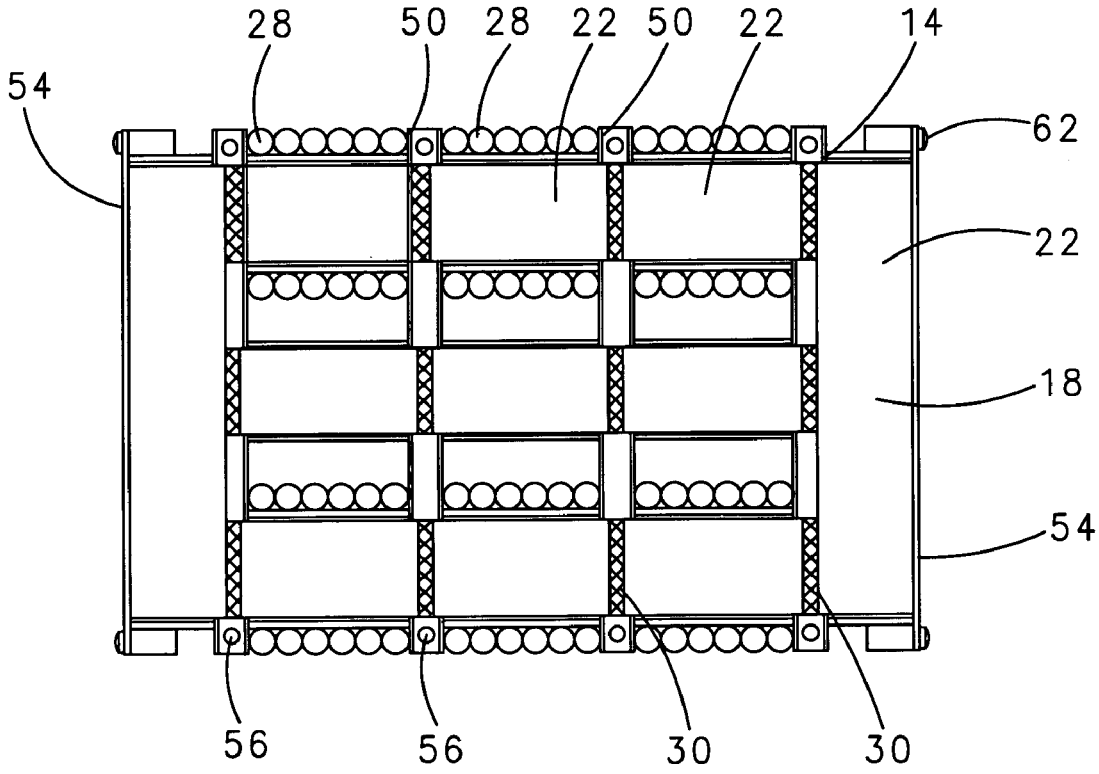
FIG. 4 is a plan view of the present invention applied to a three-phase inductor.

Referring to FIG. 4, adjustment to the length and the arrangement of the magnetic core sections 22 enables the current invention to be applied to a three-phase inductor. As shown, the threaded tie-rods 62 extend through end plates 54 securing the three rows of magnetic core sections 22 between two larger magnetic core sections 22. The air gap spacers 30 are maintained between the magnetic core sections 22 and proximate the winding sections 28 in the three-phase inductor.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A power inductor assembly comprising:

a mounting frame;

a magnetic core disposed on said mounting frame, said magnetic core having a first core section adjacent a second core section separated by an air gap spacer; and a winding having a first winding section and a second winding section, said first winding section encircling a segment of said mounting frame and said first core section, said second winding section encircling a segment of said mounting frame and said second core section.

2. The power inductor assembly of claim 1, wherein said each of said first core section and said second core section include a multitude of magnetic laminations.

3. The power inductor assembly of claim 2, wherein said multitude of magnetic laminations are arranged in stacks extending from said mounting frame.

4. A power inductor assembly comprising:

a mounting frame having a thermally conductive material coating;

a magnetic core disposed on said mounting frame, said magnetic core having a first core section adjacent a second core section separated by an air gap spacer; and a winding having a first winding section and a second winding section, said first winding section encircling a segment of said mounting frame and said first core section, said second winding section encircling a segment of said mounting frame and said second core section.

5. The power inductor assembly of claim 1, wherein said mounting frame includes mounting feet located adjacent to said air gap spacer.

6. The power inductor assembly of claim 1, including one or more end plates securing said air gap spacer between said first core section and said second core section.

7. The power inductor assembly of claim 1, wherein said air gap spacer is positioned between said first winding section and said second winding section.

8. A power inductor assembly comprising:

a multitude of magnetic laminations arranged in lamination groupings;

a mounting frame partially disposed within a winding, said winding having a multitude of winding groupings; and a multitude of air gap spacers separating said multitude of lamination groupings, wherein each of said winding groupings encircles one of said multitude of lamination groupings.

9. The power inductor assembly of claim 8, wherein said air gap spacers contact said mounting frame.

10. A power inductor assembly comprising:

a multitude of magnetic laminations arranged in lamination groupings;

a thermally conductive mounting frame partially disposed within a winding, said winding having a multitude of winding groupings; and a multitude of air gap spacers separating said multitude of lamination groupings, wherein each of said winding groupings encircles one of said multitude of lamination groupings.

11. The power inductor assembly of claim 8, including at least one end plate.

12. The power inductor assembly of claim 11, wherein said at least one end plate secures said plurality of air gap spacers.

13. A power inductor assembly comprising:

a multitude of magnetic laminations arranged in lamination groupings;

a mounting frame partially disposed within a winding, said winding having a multitude of winding groupings;

a multitude of air gap spacers separating said multitude of lamination groupings, wherein each of said winding groupings encircles one of said multitude of lamination groupings; and a heat sink adjacent said mounting frame.

14. The power inductor assembly of claim 8, wherein said multitude of magnetic laminations are arranged in a multitude of stacks extending from said mounting frame.

15. The power inductor assembly of claim 14, wherein said multitude of stacks create a multitude of interface planes between stacked magnetic laminations, said interface planes normal to said mounting frame.

16. The power inductor assembly of claim 14, wherein said stacks extend away from said mounting frame.

17. The power inductor assembly of claim 8, wherein said air gap spacers are positioned between said winding groupings.

18. The power inductor assembly of claim 8, wherein said air gap spacers are positioned outside said winding groupings.

19. The power inductor assembly of claim 1, wherein said air gap spacer is positioned outside of said first winding section and said second winding section.

* * * * *

UNITED STATES PATENT AND TRADEMARK OFFICE

CERTIFICATE OF CORRECTION

PATENT NO. : 7,573,362 B2
APPLICATION NO. : 11/247575
DATED : August 11, 2009
INVENTOR(S) : Thiel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 636 days.

Signed and Sealed this

Seventh Day of September, 2010

David J. Kappos

David J. Kappos
*Director of the United States Patent and Trademark Office*